US007578137B2

(12) United States Patent
Jang et al.

(10) Patent No.: US 7,578,137 B2
(45) Date of Patent: Aug. 25, 2009

(54) AIR-CONDITIONING SYSTEM WITH MULTIPLE INDOOR AND OUTDOOR UNITS AND CONTROL SYSTEM THEREFOR

(75) Inventors: Ji Young Jang, Sungnam-si (KR); Chan Ho Song, Koyang-si (KR); Jeong Taek Park, Ansan-si (KR); Yoon Jei Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 332 days.

(21) Appl. No.: 11/311,325

(22) Filed: Dec. 20, 2005

(65) Prior Publication Data

US 2006/0150648 A1 Jul. 13, 2006

(30) Foreign Application Priority Data

Dec. 21, 2004 (KR) ..... 10-2004-0109707

(51) Int. Cl.
*F25B 7/00* (2006.01)
*F25B 5/00* (2006.01)

(52) U.S. Cl. ..... 62/175; 62/200; 700/277

(58) Field of Classification Search ..... 62/175, 62/196.2, 200, 228.5, 332–333, 441–442; 700/276–277

See application file for complete search history.

(56) References Cited

U.S. PATENT DOCUMENTS 3,580,006 A * 5/1971 Quick ..... 62/196.2
4,122,893 A * 10/1978 Thompson ..... 165/207
4,523,436 A * 6/1985 Schedel et al. ..... 62/222
4,812,997 A * 3/1989 Okochi et al. ..... 700/277
4,878,357 A * 11/1989 Sekigami et al. ..... 62/160
5,361,595 A * 11/1994 Shimura et al. ..... 62/175
5,467,604 A * 11/1995 Sekigami et al. ..... 62/117
5,526,649 A * 6/1996 Sada ..... 62/175
6,185,946 B1 * 2/2001 Hartman ..... 62/175
6,241,156 B1 * 6/2001 Kline et al. ..... 236/49.3
6,453,689 B2 * 9/2002 Wada ..... 62/175
6,612,121 B2 * 9/2003 Moon et al. ..... 62/175
6,615,598 B1 * 9/2003 Wang et al. ..... 62/197
6,708,510 B2 * 3/2004 Sulc et al. ..... 62/151
2002/0134096 A1 * 9/2002 Shim et al. ..... 62/228.1
2003/0182021 A1 * 9/2003 Kidder ..... 700/277
2004/0204793 A1 * 10/2004 Yoon et al. ..... 700/277
2005/0081540 A1 * 4/2005 Hwang et al. ..... 62/175
2005/0155361 A1 * 7/2005 Jung et al. ..... 62/159
2006/0150648 A1 * 7/2006 Jang et al. ..... 62/200

FOREIGN PATENT DOCUMENTS

CN 1380961 A 11/2002
CN 1099554 C 1/2003
GB 2057659 A * 4/1981

* cited by examiner

*Primary Examiner*—Marc E Norman
(74) *Attorney, Agent, or Firm*—Birch, Stewart, Kolasch & Birch, LLP

(57) ABSTRACT

An air conditioner, in which a controller is installed separately from a plurality of indoor units and a plurality of outdoor units so that only the controller is added and conventional outdoor units are used when plural indoor units are required, thereby reducing costs due to the omission of other outdoor units. The controller determines whether or not the outdoor units are respectively operated according to a signal of a temperature sensing unit, and selectively operates the outdoor units according to a required capacity, thereby increasing the operating efficiency of the air conditioner.

20 Claims, 2 Drawing Sheets

AIR-CONDITIONING SYSTEM WITH MULTIPLE INDOOR AND OUTDOOR UNITS AND CONTROL SYSTEM THEREFOR

BACKGROUND OF THE INVENTION

1. Field of the Invention

The present invention relates to an air conditioner, and more particularly to an air conditioner, in which a controller is installed separately from a plurality of indoor units and a plurality of outdoor units so that only the controller is added and conventional outdoor units are used when plural indoor units are required, thereby reducing costs due to the omission of other outdoor units.

2. Description of the Related Art

Generally, air conditioners include a heating apparatus for heating an indoor space, a cooling apparatus for cooling an indoor space, and an air purifier for purifying air, thereby providing a comfortable environment for people. Particularly, a unitary air conditioner uses duct-shaped indoor units for cooling or heating a plurality of chambers.

FIG. 1 is a circuit diagram schematically illustrating a conventional air conditioner.

As shown in FIG. 1, the conventional air conditioner comprises one outdoor unit 10, one indoor unit 20, and refrigerant pipes 30 for connecting the outdoor unit 10 and the indoor unit 20 to each other so that a refrigerant is circulated in the air conditioner through a refrigerating cycle, thereby cooling or heating an indoor space.

A compressor 12 for sucking a refrigerant in a low-temperature and low-pressure gaseous state and compressing the refrigerant into a high-temperature and high-pressure state and a condenser 14 for condensing the refrigerant in the high-temperature and high-pressure state, supplied from the compressor 12, by radiating heat from the refrigerant using outdoor air are installed in the outdoor unit 10. An expansion device 22 for expanding the refrigerant, supplied from the condenser 14 through the refrigerant pipes 30 of the outdoor unit 10, into a low-temperature and low-pressure state is installed in the indoor unit 20.

The refrigerant pipes 30 of the outdoor unit 10 and the refrigerant pipes 30 of the indoor unit 20 are interconnected by service valves 32.

In the above conventional split air conditioner, when the indoor unit 20 is switched on, the compressor 12 is driven. Then, the refrigerant in the high-temperature and high-pressure state is discharged from the compressor 12, and is introduced into the condenser 14.

The refrigerant, introduced into the condenser 14, is condensed by exchanging heat with outdoor air, and is discharged from the condenser 14. Then, when the refrigerant, discharged from the condenser 14, passes through the expansion device 22, the refrigerant is decompressed into a low-temperature and low-pressure liquid state. The refrigerant in the low-temperature and low-pressure liquid state is sucked into an evaporator 24 of the indoor unit 20.

The refrigerant, sucked into the evaporator 24, cools indoor air by exchanging heat with the indoor air. Then, the refrigerant is discharged from the evaporator 24, and is supplied again to the compressor 12. Thereby, the refrigerant is circulated.

Since one outdoor unit 10 is connected to one indoor unit 20 in the conventional air conditioner, when a plurality of indoor units 20 for cooling or heating a plurality of chambers are required, a plurality of outdoor units 10 are respectively connected to the indoor units 20.

SUMMARY OF THE INVENTION

Therefore, the present invention has been made in view of the above problems, and it is an object of the present invention to provide an air conditioner, which comprises a controller for interconnecting a plurality of indoor units and a plurality of outdoor units so that the plural indoor units can be operated using conventional outdoor units, thereby reducing costs due to the omission of other outdoor units.

In accordance with the present invention, the above and other objects can be accomplished by the provision of an air conditioner comprising: a plurality of indoor units; a plurality of outdoor units connected to the indoor units; a temperature sensing unit installed indoors for sensing the temperature of indoor air; and a controller installed separately from the indoor units and the outdoor units for determining whether or not the outdoor units are respectively operated according to a signal of the temperature sensing unit and outputting an operating signal to the outdoor units.

The air conditioner may further comprise a flow rate controller provided between the indoor units and the outdoor units for adjusting flow rates of the refrigerant introduced into the indoor units and the outdoor units.

The controller may determine the flow rates introduced into the indoor units and the outdoor units according to the signal of the temperature sensing unit, and output a corresponding signal to the flow rate controller.

The flow rate controller may comprise outdoor refrigerant pipes respectively connected to the outdoor units; outdoor flow rate adjusting units installed in the outdoor refrigerant pipes for adjusting the flow rates of the refrigerant flowing along the outdoor refrigerant pipes; indoor refrigerant pipes communicating with the outdoor refrigerant pipes and respectively connected to the indoor units; and indoor flow rate adjusting units installed in the indoor refrigerant pipes for adjusting the flow rates of the refrigerant flowing along the indoor refrigerant pipes.

The outdoor flow rate adjusting units may be outdoor switching valves for opening and closing the outdoor refrigerant pipes.

The outdoor flow rate adjusting units may be installed in outdoor refrigerant discharge pipes for discharging the refrigerant out of the outdoor refrigerant pipes, and the indoor flow rate adjusting units may be installed in indoor refrigerant suction pipes for sucking the refrigerant out of the indoor refrigerant pipes.

The indoor flow rate adjusting units may be indoor switching valves respectively installed in the indoor refrigerant pipes for opening and closing the indoor refrigerant pipes.

The indoor units may comprise large-sized indoor units, each of which has an expansion device installed therein, and small-sized indoor units, each of which does not have an expansion device.

The indoor flow rate adjusting units may comprise solenoid valves respectively installed in the refrigerant pipes connected to the large-sized indoor units, and electronic expansion valves respectively installed in the refrigerant pipes connected to the small-sized indoor units for expanding the refrigerant sucked into the small-sized indoor units.

The temperature sensing unit may comprise thermostats respectively installed in the large-sized indoor units and temperature sensors respectively installed in the small-sized indoor units.

Since the controller is installed separately from a plurality of the indoor units and a plurality of the outdoor units so that only the controller is added and conventional outdoor units are used when plural indoor units are required, the air conditioner of the present invention reduces costs due to the omission of other outdoor units. Further, since controller determines whether or not the outdoor units are respectively operated according to a signal of a temperature sensing unit, the air conditioner of the present invention selectively operates the outdoor units according to a required capacity, thereby increasing operating efficiency.

Moreover, since switching valves are respectively installed in the outdoor units and the indoor units, the air conditioner of the present invention prevents the loss of a refrigerant introduced into the outdoor and indoor units, which are not operated.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the annexed drawings.

Figure 1:
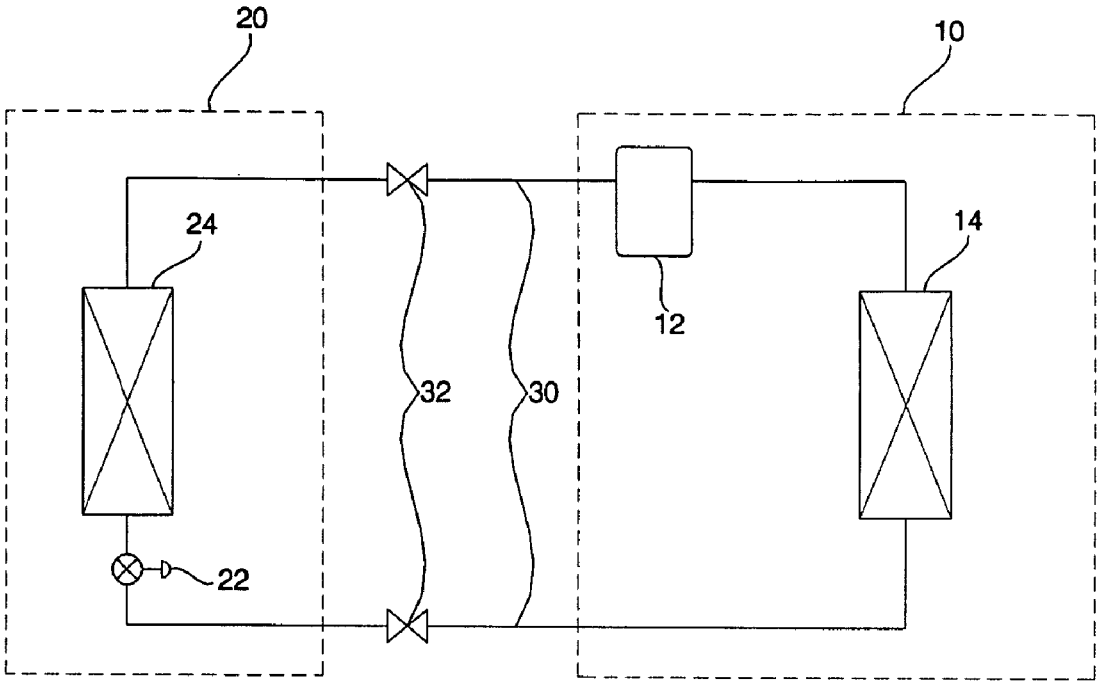
FIG. 1 (Prior Art)
FIG. 1 is a circuit diagram schematically illustrating a conventional air conditioner.
Figure 2:
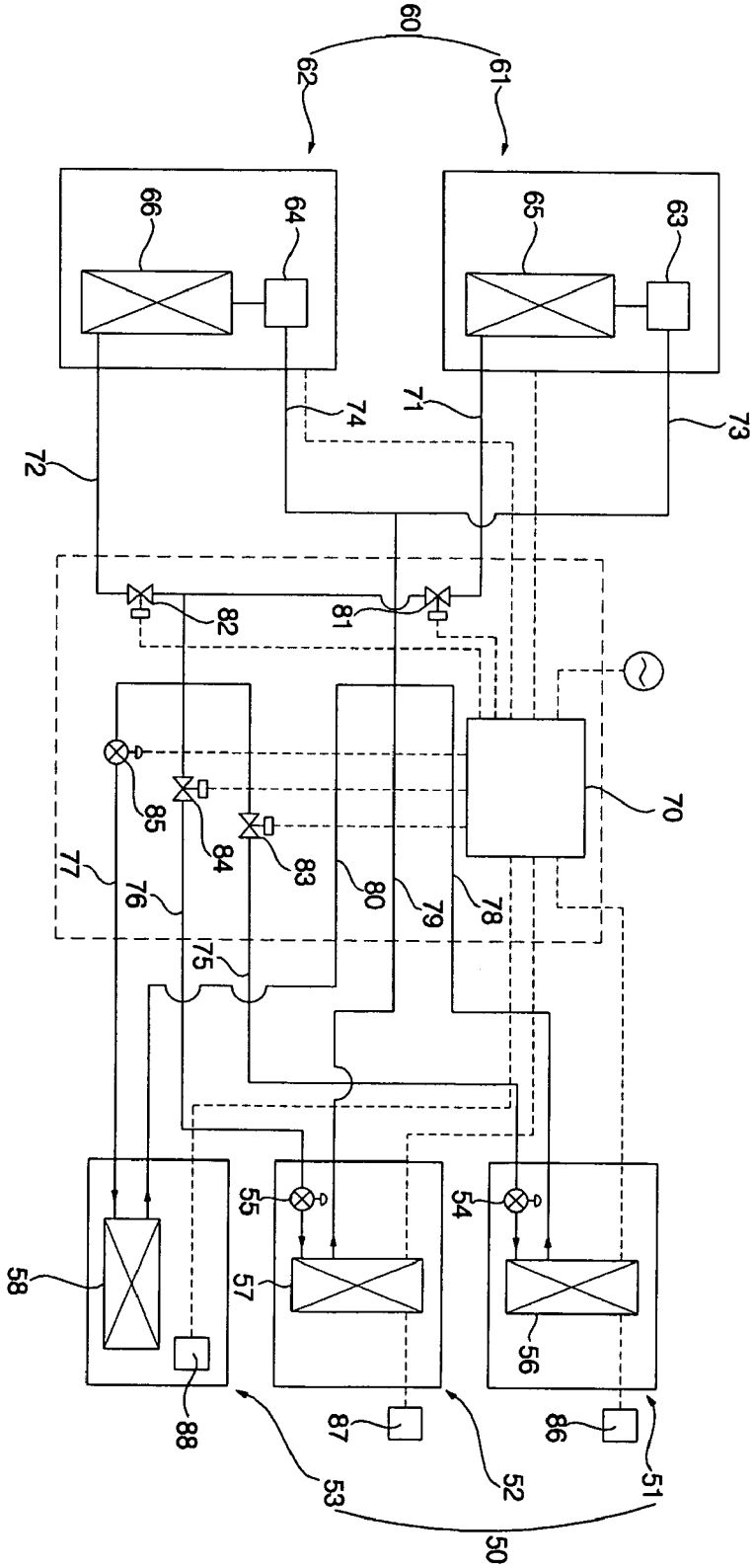
FIG. 2 is a circuit diagram schematically illustrating a multi-type unitary air conditioner in accordance with the present invention.

FIG. 2 is a circuit diagram schematically illustrating a multi-type unitary air conditioner in accordance with the present invention.

As shown in FIG. 2, the multi-type unitary air conditioner of the present invention comprises a plurality of indoor units 50, a plurality of outdoor units 60 connected to the indoor units 50, a temperature sensing unit installed in an indoor space for sensing the temperature of indoor air, and a controller 70 installed separately from the indoor units 50 and the outdoor units 60 for determining whether or not the outdoor units 60 are respectively operated according to a signal of the temperature sensing unit and outputting an operating signal to the outdoor units 60.

A plurality of the indoor units 50 include large-sized indoor units, each of which has an expansion device installed therein, and small-sized indoor units, each of which does not have an expansion device. In the present invention, as shown in FIG. 2, the indoor units 50 include large-sized first and second indoor units 51 and 52 having the structure of a duct, such as an A-coil, and a small-sized third indoor unit 53 serving as a room air conditioner.

Further, a plurality of the outdoor units 60 include first and second outdoor units 61 and 62, which are conventionally used.

That is, the first and second outdoor units 61 and 62 respectively comprise first and second compressors 63 and 64 for compressing a refrigerant, and first and second condensers 65 and 66 for condensing the refrigerant in a high-temperature and high-pressure gaseous state, supplied from the first and second compressors 63 and 64.

The first and second indoor units 51 and 52 respectively comprise first and second expansion devices 54 and 55 for expanding the refrigerant, supplied from the first and second condensers 65 and 66, and first and second evaporators 56 and 57 for evaporating the refrigerant, expanded by the first and second expansion devices 54 and 55, by absorbing external heat. The third indoor unit 53 comprises a third evaporator 58.

The air conditioner of the present invention further comprises a flow rate controller installed between the first, second, and third indoor units 51, 52, and 53 and the first and second outdoor units 61 and 62 for controlling the flow rates of the refrigerant respectively introduced into the first, second, and third indoor units 51, 52, and 53 and the first and second outdoor units 61 and 62.

The controller 70 determines whether or not the first and second outdoor units 61 and 62 are respectively operated according to the signal of the temperature sensing unit, and determines the flow rates of the refrigerant introduced into the first, second, and third indoor units 51, 52, and 53 and the first and second outdoor units 61 and 62, thereby outputting a signal to the flow rate controller.

The flow rate controller comprises first and second outdoor refrigerant pipes 71, 72, 73 and 74 respectively connected to the first and second outdoor units 61 and 62, outdoor flow rate adjusting units installed in the first and second outdoor refrigerant pipes 71, 72, 73 and 74 for adjusting the flow rates of the refrigerant flowing along the first and second outdoor refrigerant pipes 71, 72, 73 and 74, first, second, and third indoor refrigerant pipes 75, 76, 77, 78, 79, and 80 communicating with the first and second outdoor refrigerant pipes 71, 72, 73 and 74 and respectively connected to the first, second, and third indoor units 51, 52, and 53, and indoor flow rate adjusting units installed in the first, second, and third indoor refrigerant pipes 75, 76, 77, 78, 79, and 80 for adjusting the flow rates of the refrigerant flowing along the first, second, and third indoor refrigerant pipes 75, 76, 77, 78, 79, and 80.

Here, the first and second outdoor refrigerant pipes 71, 72, 73 and 74 include first and second outdoor refrigerant suction pipes 73 and 74 for guiding the refrigerant respectively sucked into the first and second outdoor units 61 and 62, and first and second outdoor refrigerant discharge pipes 71 and 72 for guiding the refrigerant respectively discharged from the first and second outdoor units 61 and 62.

The outdoor flow rate adjusting units are respectively installed in the first and second outdoor refrigerant discharge pipes 71 and 72 for closing the discharge pipe(s) of the outdoor unit(s), which is/are not operated, so as to prevent the loss of the refrigerant. Here, the outdoor flow rate adjusting units are first and second outdoor switching valves 81 and 82 for opening and closing the first and second outdoor refrigerant discharge pipes 71 and 72.

The first, second, and third indoor refrigerant pipes 75, 76, 77, 78, 79, and 80 are branched from a main pipe formed by joining the first and second outdoor refrigerant pipes 71, 72, 73 and 74, and are respectively connected to the first, second, and third indoor units 51, 52, and 53. The first, second, and third indoor refrigerant pipes 75, 76, 77, 78, 79, and 80 include first, second, and third indoor refrigerant suction pipes 75, 76, and 77 for guiding the refrigerant respectively sucked into the first, second, and third indoor units 51, 52, and 53, and first, second, and third indoor refrigerant discharge pipes 78, 79, and 80 for guiding the refrigerant respectively discharged from the first, second, and third indoor units 51, 52, and 53.

The indoor flow rate adjusting units are respectively installed in the first, second, and third indoor refrigerant suction pipes 75, 76, and 77 for closing the suction pipe(s) of the indoor unit(s), which is/are not operated, so as to prevent the loss of the refrigerant. Here, the indoor flow rate adjusting units are first, second, and third indoor switching valves 83, 84, and 85 for opening and closing the first, second, and third indoor refrigerant suction pipes 75, 76, and 77.

Since the first and second expansion devices 54 and 55 are installed in the first and second indoor units 51 and 52, solenoid valves for opening and closing the first and second indoor refrigerant suction pipes 75 and 76 are preferably used as the first and second indoor switching valves 83 and 84. Further, since an expansion device is not installed in the third indoor unit 53, an electronic expansion valve for expanding the refrigerant and for opening and closing the third indoor refrigerant suction pipes 77 is preferably used as the third indoor switching valve 85.

The temperature sensing unit comprises first and second thermostats 86 and 87 provided in indoor spaces, where the first and second indoor units 51 and 52 are respectively installed, for sensing the temperatures of the indoor spaces, and a temperature sensor 88 installed on the third indoor unit 53 for sensing the temperature of indoor air. The first and second thermostats 86 and 87 and the temperature sensor 88 are connected to the controller 70, thus transmitting signals sensed thereby to the controller 70.

Here, the first and second thermostats 86 and 87 not only sense the indoor temperatures, but also compare the sensed indoor temperatures to designated temperatures and output signals so that the first and second indoor units 51 and 52 are respectively operated according to the obtained comparison results.

First, the controller 70 determines a target indoor temperature according to the signals inputted from the first and second thermostats 86 and 87 and the temperature sensor 88. Then, the controller 70 selects the outdoor unit(s) to be operated, out of the first and second outdoor units 61 and 62, controls the operation of the first and second outdoor units 61 and 62 and the operation of the first and second outdoor switching valves 81 and 82, determines the flow rates of the refrigerant supplied to the first, second, and third evaporators 56, 57, and 58, and controls the operation of the first, second, and third indoor switching valves 83, 84, and 85 according to the determined flow rates of the refrigerant.

The controller 70 is installed separately from the first, second, and third indoor units 51, 52, and 53 and the first and second outdoor units 61 and 62. Accordingly, when a plurality of indoor units are required, conventional outdoor units and conventional indoor units are used and only the controller 70 is added.

Hereinafter, the operation of the air conditioner of the present invention will be described, as below.

First, the first and second thermostats 85 and 86 and the temperature sensor 87 senses temperatures of indoor air, and transmit the sensed temperatures to the controller 70.

The controller 70 determines a target indoor temperature according to the signals supplied from the first and second thermostats 85 and 86 and the temperature sensor 87, selects the outdoor unit(s) to be operated, out of the first and second outdoor units 61 and 62, and outputs an operating signal to the selected outdoor unit(s).

Here, the controller 70 selects only the first outdoor unit 61. The controller 70 outputs the operating signal to the first outdoor unit 61, controls the second outdoor switching valve 82 installed in the second outdoor refrigerant discharge pipe 72 so that the second outdoor switching valve 82 closes the second outdoor refrigerant discharge pipe 72, thereby preventing the refrigerant, discharged from the first outdoor unit 61, from being introduced into the second outdoor unit 62.

Further, the controller 70 controls the first, second, and third indoor switching valves 83, 84, and 85 so that the refrigerant is introduced only into the operating indoor unit(s) from among the first, second, and third indoor units 51, 52, and 53 according to whether or not the first, second, and third indoor units 51, 52, and 53 are respectively operated.

Here, only the first indoor unit 51 and the third indoor unit 53 are operated. The controller 70 controls the second indoor switching valve 84 so that the second indoor switching valve 84 closes the second indoor refrigerant suction pipe 76, thereby preventing the refrigerant from being introduced into the second indoor unit 52.

Further, the controller 70 controls the first and third indoor switching valves 83 and 85 so that the refrigerant is introduced into the first and third indoor refrigerant suction pipes 75 and 77. Since the third indoor switching valve 85 is an electronic expansion valve, the controller 70 controls the opening degree of the third indoor switching valve 85 so that the flow rate of the refrigerant introduced into the third indoor unit 53 is controlled and the refrigerant introduced into the third indoor unit 53 is expanded.

Accordingly, since whether or not the first and second outdoor units 61 and 62 are operated is determined by the temperatures of indoor air, and the flow rates of the refrigerant introduced into the first, second, and third indoor units 51, 52, and 53 are determined by the temperatures of the indoor air and whether or not the first, second, and third indoor units 51, 52, and 53 are operated, the multi-type unitary air conditioner of the present invention for conditioning air in a plurality of chambers is embodied by adding only the controller 70 to conventional indoor and outdoor units.

As apparent from the above description, the present invention provides an air conditioner, in which a controller is installed separately from a plurality of indoor units and a plurality of outdoor units so that only the controller is added and conventional outdoor units are used when plural indoor units are required, thereby reducing costs due to the omission of other outdoor units. Further, since the controller determines whether or not the outdoor units are respectively operated according to a signal of a temperature sensing unit, the air conditioner of the present invention selectively operates the outdoor units according to a required capacity, thereby increasing operating efficiency.

Moreover, since switching valves are respectively installed in the outdoor units and the indoor units, the air conditioner of the present invention prevents the loss of a refrigerant introduced into the outdoor and indoor units, which are not operated.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An air conditioner comprising:

a plurality of indoor units;

a plurality of outdoor units connected to the indoor units;

a temperature sensing unit installed indoors for sensing the temperature of indoor air;

a flow rate controller provided between the indoor units and the outdoor units for adjusting flow rates of refrigerant introduced into each of the indoor units and each of the outdoor units; and a controller installed separately from the indoor units and the outdoor units for determining whether or not the outdoor units are respectively operated and determining the flow rate of the refrigerant introduced into each of the indoor units and each of the outdoor units according to a signal of the temperature sensing unit, and outputting an operating signal directly to the outdoor units and outputting an adjusting signal directly to the flow rate controller.

2. The air conditioner as set forth in claim 1, wherein the flow rate controller comprises:

outdoor refrigerant pipes respectively connected to the outdoor units;

outdoor flow rate adjusting units installed in the outdoor refrigerant pipes for adjusting the flow rates of the refrigerant flowing along the outdoor refrigerant pipes;

indoor refrigerant pipes communicating with the outdoor refrigerant pipes and respectively connected to the indoor units; and indoor flow rate adjusting units installed in the indoor refrigerant pipes for adjusting the flow rates of the refrigerant flowing along the indoor refrigerant pipes.

3. The air conditioner as set forth in claim 2, wherein the outdoor flow rate adjusting units are outdoor switching valves for opening and closing the outdoor refrigerant pipes.

4. The air conditioner as set forth in claim 2, wherein the outdoor flow rate adjusting units are installed in outdoor refrigerant discharge pipes for discharging the refrigerant out of the outdoor refrigerant pipes, and the indoor flow rate adjusting units are installed in indoor refrigerant suction pipes for sucking the refrigerant out of the indoor refrigerant pipes.

5. The air conditioner as set forth in claim 2, wherein the indoor flow rate adjusting units are indoor switching valves respectively installed in the indoor refrigerant pipes for opening and closing the indoor refrigerant pipes.

6. The air conditioner as set forth in claim 2, wherein the indoor units comprise large-sized indoor units, each of which has an expansion device installed therein, and small-sized indoor units, each of which does not have an expansion device.

7. The air conditioner as set forth in claim 6, wherein the indoor flow rate adjusting units comprise solenoid valves installed in the refrigerant pipes connected to said other the indoor units, and electronic expansion valves installed in the refrigerant pipes connected to an outdoor unit having the smallest cooling capacity.

8. The air conditioner as set forth in claim 6, wherein the temperature sensing unit comprises thermostats respectively installed in said other indoor units and temperature sensors installed in the indoor unit having the smallest cooling capacity.

9. An air conditioner comprising:

a plurality of indoor units;

a plurality of outdoor units connected to the indoor units;

a controller installed separately from the indoor units and the outdoor units for determining flow rates of a refrigerant introduced into the indoor units and the outdoor units and outputting a signal corresponding to the flow rates; and a flow rate controller provided between the indoor units and the outdoor units for adjusting the flow rates of the refrigerant introduced into the indoor units and the outdoor units directly according to the signal outputted from the controller.

10. The air conditioner as set forth in claim 9, wherein the flow rate controller comprises:

outdoor refrigerant pipes respectively connected to the outdoor units;

outdoor flow rate adjusting units installed in the outdoor refrigerant pipes for adjusting the flow rates of the refrigerant flowing along the outdoor refrigerant pipes;

indoor refrigerant pipes communicating with the outdoor refrigerant pipes and respectively connected to the indoor units; and indoor flow rate adjusting units installed in the indoor refrigerant pipes for adjusting the flow rates of the refrigerant flowing along the indoor refrigerant pipes.

11. The air conditioner as set forth in claim 10, wherein the outdoor flow rate adjusting units are outdoor switching valves for opening and closing the outdoor refrigerant pipes.

12. The air conditioner as set forth in claim 10, wherein the outdoor flow rate adjusting units are installed in outdoor refrigerant discharge pipes for discharging the refrigerant out of the outdoor refrigerant pipes, and the indoor flow rate adjusting units are installed in indoor refrigerant suction pipes for sucking the refrigerant out of the indoor refrigerant pipes.

13. The air conditioner as set forth in claim 10, wherein the indoor flow rate adjusting units are indoor switching valves respectively installed in the indoor refrigerant pipes for opening and closing the indoor refrigerant pipes.

14. The air conditioner as set forth in claim 10, wherein at least one of the indoor units has a capacity smaller than the other indoor units.

15. The air conditioner as set forth in claim 14, wherein the indoor flow rate adjusting units comprise solenoid valves installed in the refrigerant pipes connected to said other indoor units, and electronic expansion valves installed in the refrigerant pipes connected to the indoor unit having the smallest cooling capacity.

16. The air conditioner as set forth in claim 14, further comprising a temperature sensing unit installed indoors where the indoor units are respectively installed for sensing the temperature of the indoor air, wherein the temperature sensing unit comprises thermostats installed in said other indoor units and temperature sensors installed in the indoor unit having the smallest cooling capacity.

17. The air conditioner as set forth in claim 16, wherein the controller controls the flow rate controller according to the temperature sensed by the temperature sensing unit.

18. The air conditioner as set forth in claim 2, wherein the outdoor flow rate adjusting units are located separately from the outdoor units, and the indoor flow rate adjusting units are located separately from the indoor units.

19. The air conditioner as set forth in claim 10, wherein the outdoor flow rate adjusting units are located separately from the outdoor units, and the indoor flow rate adjusting units are located separately from the indoor units.

20. An air conditioner comprising:

a plurality of indoor units;

a plurality of outdoor units connected to the indoor units;

a controller installed separately from the indoor units and the outdoor units for determining flow rates of a refrigerant introduced into the indoor units and the outdoor units and outputting a signal corresponding to the flow rates; and a flow rate controller provided between the indoor units and the outdoor units for adjusting the flow rates of the refrigerant introduced into the indoor units and the outdoor units according to the signal outputted from the controller, the flow rate controller including:

outdoor flow rate adjusting units located separately from the outdoor units for adjusting the flow rates of the refrigerant flowing to and from the outdoor units; and indoor flow rate adjusting units located separately from the indoor units for adjusting the flow rates of the refrigerant flowing to and from the indoor units.

* * * * *